United States Patent [19]

Nadler

[11] 4,156,947

[45] Jun. 5, 1979

[54] METHOD OF MANUFACTURING SHOES

[76] Inventor: Martin S. Nadler, 208 Alpine Dr., Paramus, N.J. 07652

[21] Appl. No.: 840,535

[22] Filed: Oct. 11, 1977

[51] Int. Cl.[2] ..... A43D 21/00; A43B 00/00

[52] U.S. Cl. ..... 12/142 R; 12/145; 36/83

[58] Field of Search ..... 12/142 R, 142 F, 142 G, 12/142 RS, 142 T, 142 S, 145; 36/83

[56] References Cited

U.S. PATENT DOCUMENTS

| | | | |
|---|---|---|---|
| 2,287,342 | 6/1942 | Butler | 12/142 B |
| 2,391,789 | 12/1945 | Lumbard | 12/142 B |
| 2,648,080 | 8/1953 | Garofalo | 12/145 |
| 2,658,215 | 11/1953 | Pepe | 12/145 |

*Primary Examiner*—Patrick D. Lawson
*Attorney, Agent, or Firm*—Darby & Darby

[57] ABSTRACT

A shoe having the appearance, but not the construction, of a compo cement shoe has an upper, an inner sole stitched to the lower peripheral portion of the upper, and an outer sole attached to the underside of the upper and inner sole.

In the method for manufacturing such shoes the pieces of the upper are first sewn together, the toe portion of the upper is crimped, gathered, and stitched and the inner sole is then positioned coplanar with the lower peripheral portion of the upper in the area circumscribed by the lower peripheral edge of the upper and sewn thereto. Finally, an outer sole is attached to the combined upper and inner sole assembly.

3 Claims, 6 Drawing Figures

METHOD OF MANUFACTURING SHOES

BACKGROUND OF THE INVENTION

The present invention relates to a shoe construction and a method for manufacturing such shoes.

A type of shoe in common use today is known as a compo cement shoe. In the manufacture of the compo shoe, the inner sole or insole is first tacked to the bottom of a last and the upper is then pulled over the last. Then the lasting operation is begun. This involves seating the heel portion of the upper under the last and then assembling the toe portion of the upper under the last. The assembling operation involves forming pleats on the underside of the upper and then using a plate to wipe or smooth the pleats. After the heel and toe lasting operations are completed, the shoe is side lasted. Then, the inner surface of the lower peripheral or turned in portion of the upper is cemented to the outer peripheral portion of the insole which is tacked onto the last. Then, the outer surface of the lower peripheral portion of the upper is roughened so that the outer sole may be glued to it.

The inner sole is a key element in the construction of compo cement shoes. Since it is the element which is cemented to the upper, it must be composed of a material which is relatively firm and stiff, such as the Texon inner sole made by Texon Corporation. This type inner sole causes the compo cement shoe to be somewhat rigid.

Another disadvantage of the traditional compo cement shoe results from the cavity which is formed beneath the central portion of the inner sole—as explained above, the outer peripheral portion of the inner sole is cemented or glued to the inner surface of the lower peripheral portion of the upper. This cavity often causes foot discomfort to the wearer.

Because the outer sole is only attached to the perimeter of the upper, after hard wear the outer sole often pulls away from the upper. Furthermore, when the outer sole pulls away from the upper, the inner sole or midsole is exposed and continued use of the shoe causes the inner sole to pull away from the upper and the shoe falls apart.

A distinct disadvantage in the manufacture of the compo cement shoe is the large, cumbersome and expensive machinery which must be used to perform the lasting operation.

Accordingly, it is an object of the present invention to provide a shoe which has the stylish appearance of a compo cement shoe but which is more flexible than compo cement shoes heretofore known.

A further object is to provide a shoe having the appearance of a compo cement shoe which does not have a cavity under the central portion of the inner sole and is therefore more comfortable and more durable.

Still a further object of the present invention is to provide a method of manufacturing a shoe having the appearance of a compo cement shoe with relatively inexpensive equipment which is easy to operate.

SUMMARY OF THE INVENTION

These and other objects are achieved by a new shoe manufacturing method which results in a new type of shoe construction. Briefly, each portion of the shoe upper is sewn together before the upper is put on a last. The toe portion of the shoe upper is crimped and stitched by an operation described in the following patents:

- U.S. Pat. No. 2,774,087 to J. D. Bozza for "Method for Securing Together Moccasin Vamps and Plugs", issued Dec. 18, 1956;
- U.S. Pat. No. 2,946,069 to J. D. Bozza for "Method of Manufacturing Moccasins", issued July 26, 1960; and
- U.S. Pat. No. 2,999,323 to J. D. Bozza for "Moccasins and Footwear", issued Sept. 12, 1961.

That is, the lower peripheral portion of the upper in the toe region is gathered or crimped and a cord or tape is secured along the gathered edge by stitching to permanently retain the curved front edge of the upper in its gathered condition. Following this operation, an inner sole, which complements the opening formed by the edge of the lower peripheral portion of the shoe upper, is positioned within the opening with its edges abutting or nearly reaching the corresponding edge of the lower peripheral portion of the upper, so that the inner sole is substantially coplanar with the lower peripheral portion of the shoe upper. Thereafter, the inner sole is stitched to the lower peripheral portion of the upper by the same process described in the Bozza patents referred to above, namely, the use of an overedge sewing machine which can gather together with ease the edges of the inner sole and the lower peripheral portion of the upper and which affords a chain stitch loose enough so that the stitched together edges of the inner sole and upper will be permitted to open up and flatten out to provide a flat cementing surface. The outer sole is then attached to the upper assembly by any desired method. When using the cement technique, the adhesive or cement may be disposed along the coplanar surfaces of the lower peripheral portion of the upper and the insole so as to bond the entire surface of the bottom of the shoe (peripheral portion of the upper and the insole) to the entire surface of the outersole, as opposed to the conventional compo cement process in which adhesive is applied only to the surface of the marginal or peripheral portion of the upper which is turned down under the insole. Alternatively, a leather or crepe sole can be stitched to the lower peripheral portion of the upper by a conventional Littleway stitcher.

BRIEF DESCRIPTION OF THE DRAWINGS

In describing a preferred embodiment of the present invention, reference is made to the drawings in which.

DESCRIPTION OF A PREFERRED EMBODIMENT

Figure 1:
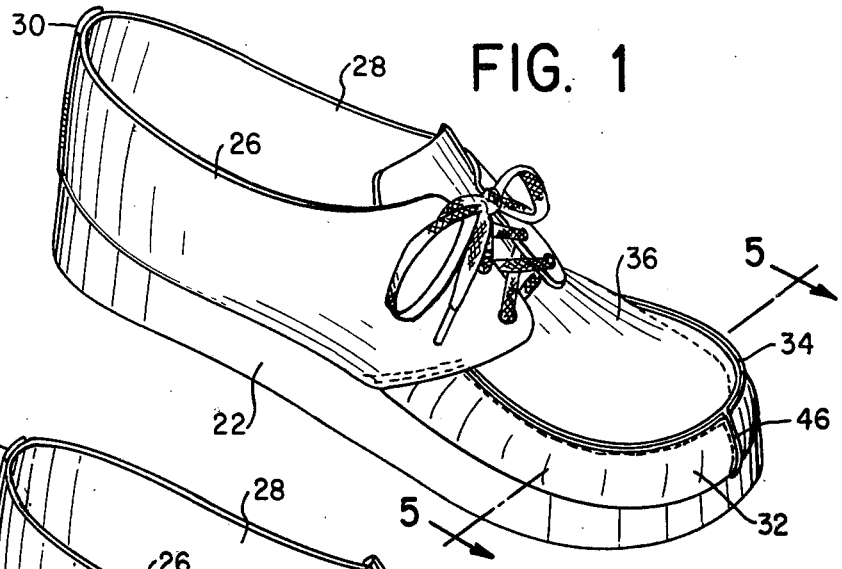
FIG. 1 is a perspective view of a shoe embodying the present invention having the appearance of a traditional compo cement shoe.
Figure 2:
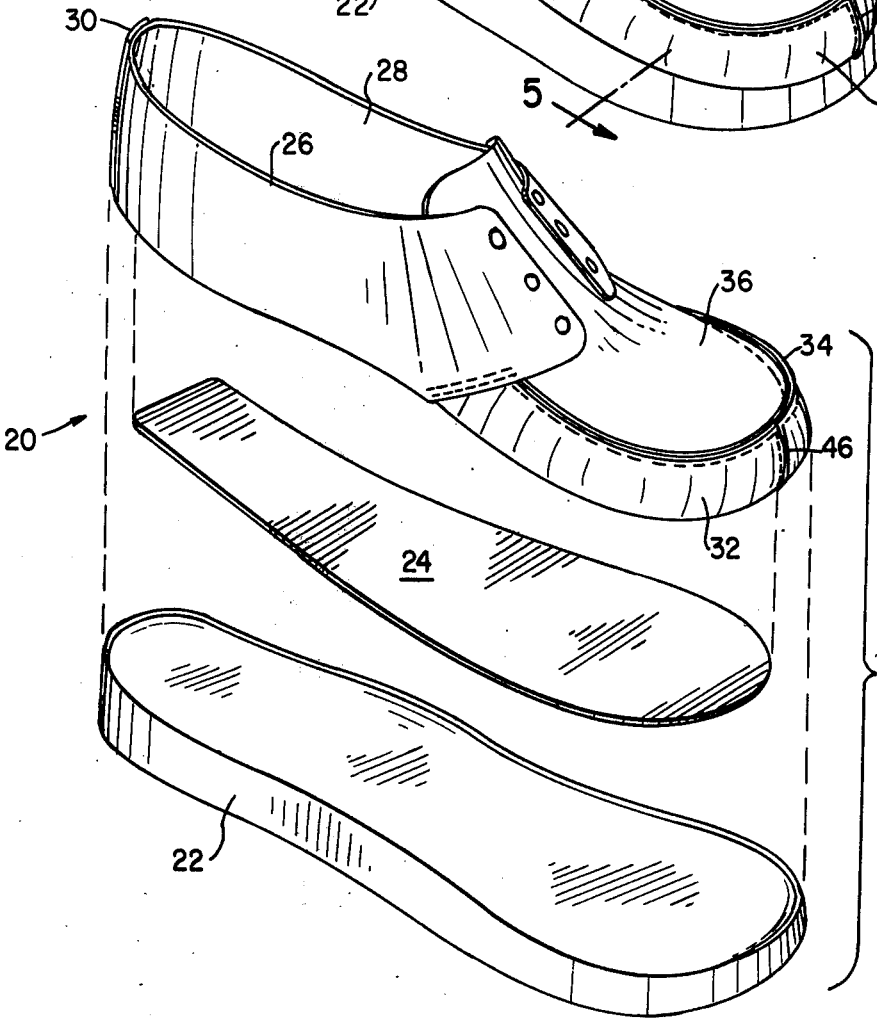
FIG. 2 is an exploded view of the shoe of FIG. 1 showing the upper, insole and outer sole before assembly.
Figure 3:
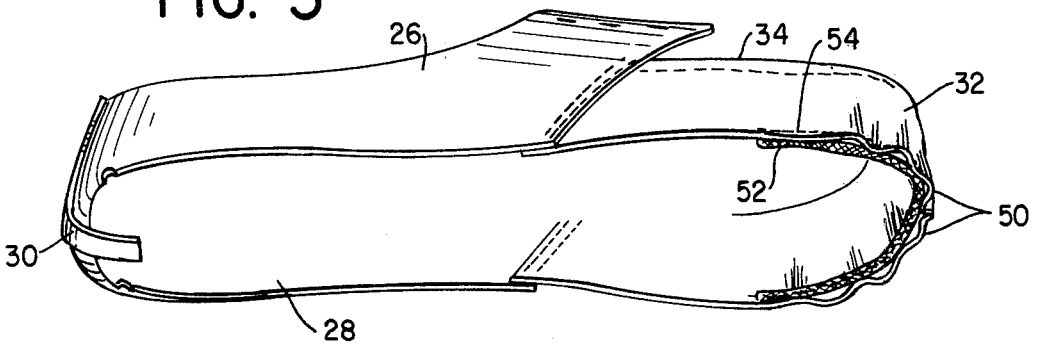
FIG. 3 is a bottom perspective view showing a detail of the construction of the shoe in an intermediate stage of manufacture.

Referring now to the drawings, the embodiment of the invention illustrated therein comprises a shoe generally designated 20, including an outer sole 22, an inner sole 24, a pair of rear quarter uppers 26, 28 joined in the rear by a tail piece 30, a pair of front quarter uppers 32, 34, and a plug 36 secured in the upper part of the fore quarter uppers 32 and 34. However, any configuration upper may be used in constructing the footwear of this invention.

In manufacturing the shoe of this embodiment, the pieces of the upper are sewn together before the upper is placed on the last. The pieces of the upper may be sewn together in the following manner: First, the rear quarters 26 and 28 are placed so that their respective rear edges abut, and the two pieces are sewn together with a conventional zigzag stitch. Thereafter, the tail piece 30 may be sewn to the outside of the joined quarters 26 and 28 and stitched with a conventional through stitch.

Next, the vamp pieces 32 and 34 of the upper are sewn together by superposing one over the other in back-to-back manner and joining the two with a through stitch at the front portions of each to form a nub 46 on the outside of the shoe. Next the toe portion of the upper is formed by introducing a permanent curve into the lower portion of the vamp pieces. More particularly, the front portion of vamp pieces 32 and 34 are provided with a plurality of relatively minute gathers or crimps 50, and a cord or tape 52 is secured along the gathered edges by an adhesive or by stitching 54 to permanently retain the curved front edges of the quarters 32 and 34 in their gathered condition. The cord or tape 52 must be non-elastic, or inextensible to provide a maximum of restraining force.

Figure 6:
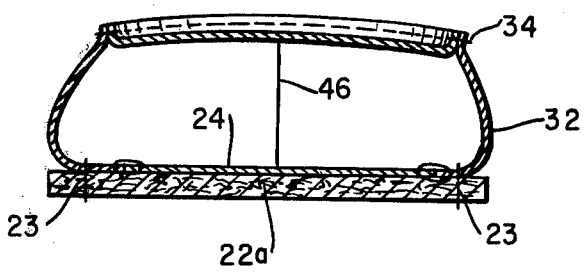
FIG. 6 is a modified construction in which the outer sole is stitched to the lower peripheral portion of the upper.

FIGS. 6, 7 and 8 of U.S. Pat. No. 2,949,069 to J. D. Bozza, and the accompanying description in the patent, illustrate the machinery and describe the preferred manner for forming the curve in the toe portion of the shoe 20. Although the description in the Bozza patent is with relation to crimping the top peripheral portion of the toe part of the upper, the same process can be used to crimp the lower peripheral portion of the toe part of the upper to make the shoes of this invention. The crimping or gathering operation serves to draw up the marginal portion of the fore quarters 32 and 34 so as to properly form the toe portion of the shoe.

Next, plug 36 is stitched to the vamp piece by aligning the edges of plug 36 with the now-curved edges of the vamp piece. The plug 36 is then sewn by conventional through stitching. Next the rear quarter section formed by the two tail quarters 26 and 28 is aligned with the now-assembled plug and vamp piece assembly and stitched by conventional techniques, as, for example, by a through stitch.

The next step in the manufacture of the shoe involves pre-roughing the marginal edge or peripheral portion of the upper which is to be joined to the innersole. The pre-roughing step is accomplished with a conventional wire roughing wheel. Usually, a marking is made on the upper to define the peripheral portion of the upper which is to be folded under the last. This marked area is usually pre-roughed up to within approximately 1/16th of an inch of the marking. The purpose of the roughing is, of course, to provide a better bonding surface once the adhesive is applied.

Figure 4:
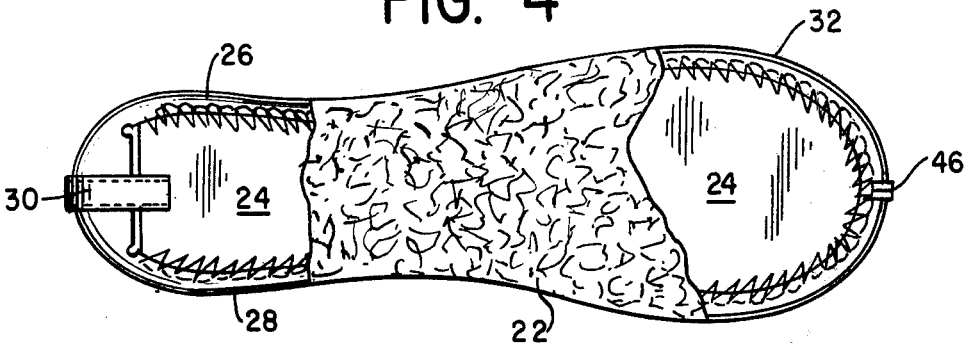
FIG. 4 is a bottom view showing a detail of the construction of the compo shoe at a subsequent intermediate stage of manufacture.
Figure 5:
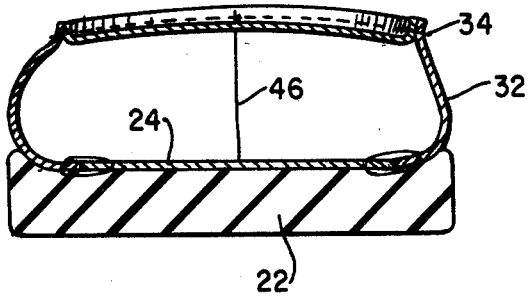
FIG. 5 is a cross-sectional view of a completed shoe.

The upper is now ready to be joined to the inner sole 24 which may be made of a relatively flexible material (in comparison to a Texon inner sole) such as, for example, ground leather or any other inexpensive but firm material. The shape and sides of the inner sole 24 conform closely to the area or opening defined by the turned in or lower peripheral portion of the upper as shown in FIG. 4. Accordingly, the inner sole 24 is positioned within the cavity opening so that its edge abuts or substantially abuts the edge of the lower peripheral portion of the upper and is coplanar with it. The inner sole 24 is then stitched to the turned in or lower peripheral portion of the upper with an overedge sewing machine using a chain stitch as disclosed in the Bozza patents referred to above. Each stitch obtained by the overedge sewing machine has a single thread running through the inner sole and the lower peripheral portion of the upper and a locking loop to one side. By suitably selecting the tightness of the chain stitch, the edges of the inner sole and lower peripheral portion of the upper will be permitted to open up and flatten out to provide a flat cementing surface with the inner sole forming a smooth continuation of the upper.

Next, the upper is forced lasted, that is, the last is forced into the shoe, and the shoe is lined up on the last so that the marking mentioned above coincides with the outermost peripheral edge of the bottom surface of the shoe. If needed, the peripheral portion of the upper which is folded under the last is feather roughed on a conventional roughing machine to account for any stretching or lack of stretching in the upper after it has been forced lasted. In this way, the entire marginal or peripheral portion of the upper which is folded under the last is roughened so as to provide a better bond with the outer sole. A prefabricated sole can be cemented on with glue or other adhesive to give the appearance of a conventional compo cement shoe. Alternatively, a crepe or leather sole **22*a* can be stitched onto the upper with stitches 23** using a conventional Littleway stitcher.

The fully assembled shoe substantially forms a true moccasin in that there is no cavity formed between the inner sole and the outer sole, as in the conventional compo cement shoes. This is because the inner sole 24 complements the opening formed by the lower peripheral portion of the upper. Since the inner sole may be made of a flexible material, the shoe offers the comfort of a real moccasin.

Moreover, when the outer sole 22 is cemented to the upper, it is not only bonded to a marginal portion of the upper, as in the traditional compo cement shoe, but it is also bonded to the inner sole, which is coplanar with the lower peripheral portion of the upper. As a result, if the cement bond between the outer sole and the lower peripheral portion of the upper fails, the bond between the inner sole and the outer sole still remains. The likelihood of the upper pulling away from the inner sole, as in traditional compo cement shoes, is minimal because the inner sole is stitched to the upper.

Accordingly, the advantages of a shoe produced according to the foregoing method include the flexibility of a moccasin and excellent durability and wearing quality. Additionally, this method requires a minimum of low priced, easy to operate equipment, whereas the traditional method of manufacturing a compo cement shoe requires sophisticated and expensive equipment which is difficult to operate.

It will be apparent to those skilled in the art that the present invention may take a variety of forms, and that the foregoing description is illustrative only and that the scope of protection afforded this invention be determined by the appended claims.

What is claimed is:

1. The method of manufacturing footwear comprising the steps of:

forming a toe pocket in a footwear upper;

stitching an inner sole to the lower peripheral portion of the footwear upper with a chain stitch loose enough so that the stitched together edges of the inner sole and upper will be permitted to open up and flatten out to provide a flat surface with the inner sole substantially coplanar with the lower peripheral portion of the footwear upper;

and then forcing the now intergral stitched together upper and inner sole onto a last so that the lower peripheral portion of the upper is positioned down under the last.

2. The method according to claim 1 including the further step of cementing an outer sole to the substantially coplanar lower peripheral portion of the footwear upper and inner sole.

3. The method according to claim 1 including the further step of stitching an outer sole to the lower peripheral portion of the footwear upper.

* * * * *